US008479845B1

(12) United States Patent
Qian et al.

(10) Patent No.: US 8,479,845 B1
(45) Date of Patent: Jul. 9, 2013

(54) CUTTING ELEMENT ASSEMBLY INCLUDING ONE OR MORE SUPERABRASIVE CUTTING ELEMENTS, DRILL BIT UTILIZING THE SAME, AND METHODS OF MANUFACTURE

(75) Inventors: Jiang Qian, Cedar Hills, UT (US); Debkumar Mukhopadhyay, Sandy, UT (US); Jason Wiggins, Draper, UT (US); Kenneth E. Bertagnolli, Riverton, UT (US); Shawn C. Scott, Payson, UT (US); Kevin Duy Nguyen, Riverton, UT (US); Michael A. Vail, Genola, UT (US)

(73) Assignee: US Synthetic Corporation, Orem, UT (US)

( * ) Notice: Subject to any disclaimer, the term of this patent is extended or adjusted under 35 U.S.C. 154(b) by 337 days.

(21) Appl. No.: 12/853,752

(22) Filed: Aug. 10, 2010

Related U.S. Application Data

(60) Provisional application No. 61/325,882, filed on Apr. 20, 2010.

(51) Int. Cl.
*E21B 10/42* (2006.01)

(52) U.S. Cl.
USPC ..... 175/426; 175/432

(58) Field of Classification Search
USPC ..... 175/426, 431, 432, 434
See application file for complete search history.

(56) References Cited

U.S. PATENT DOCUMENTS

| | | | | |
|---|---|---|---|---|
| 6,131,678 | A * | 10/2000 | Griffin | 175/434 |
| 6,283,234 | B1 * | 9/2001 | Torbet | 175/432 |
| 8,191,658 | B2 * | 6/2012 | Schmitz et al. | 175/434 |
| 2007/0278017 | A1 | 12/2007 | Shen et al. | |
| 2008/0304928 | A1 * | 12/2008 | Engstrom et al. | 408/229 |

* cited by examiner

*Primary Examiner* — William P Neuder
(74) *Attorney, Agent, or Firm* — Workman Nydegger

(57) ABSTRACT

Some embodiments relate to cutting element assemblies including a superabrasive cutting element that may be axially compressed to enhance the damage tolerance thereof, enclosed in an enclosure that exposes the superabrasive cutting element therethrough, enclosed in an enclosure that restricts rotation of the superabrasive cutting element, or combinations of the foregoing. Additionally, some embodiments relate to cutting element assemblies in which a superabrasive cutting element is mechanically fastened to a base, such as a substrate or directly to a bit body of a rotary drill bit. Some embodiments also relate to cutting element assemblies including one or more superabrasive cutting elements that are rotatable about a longitudinal axis of the cutting element assembly, that may be axially compressed to enhance the damage tolerance thereof, that may be enclosed in an enclosure that exposes the superabrasive cutting element therethrough, or combinations thereof.

22 Claims, 11 Drawing Sheets

CUTTING ELEMENT ASSEMBLY INCLUDING ONE OR MORE SUPERABRASIVE CUTTING ELEMENTS, DRILL BIT UTILIZING THE SAME, AND METHODS OF MANUFACTURE

CROSS-REFERENCE TO RELATED APPLICATIONS

This application claims the benefit of U.S. Provisional Application No. 61/325,882 filed on 20 Apr. 2010, the disclosure of which is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate (e.g. a cemented carbide) using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements connected to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a substrate into a container with a volume of diamond particles positioned on a surface of the substrate. A number of such containers may be loaded into an HPHT press. The substrate (s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented-carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

Despite the availability of a number of different PDCs, manufacturers and users of PDCs continue to seek cutting element assemblies and cutting elements that exhibit improved toughness, wear resistance, thermal stability, or combinations of the foregoing properties.

SUMMARY

In an embodiment, a cutting element assembly includes an enclosure defining a recess, at least one cutting opening, and a longitudinal axis. A base is disposed in the recess, and a superabrasive cutting element is disposed in the recess between the enclosure and the base. The superabrasive cutting element is exposed through the at least one cutting opening. Rotation of the superabrasive cutting element relative to the enclosure may be restricted about the longitudinal axis of the enclosure.

In an embodiment, a cutting element assembly includes an enclosure defining a recess and at least one cutting opening. A base is disposed in the recess, and a superabrasive cutting element is also disposed in the recess between the enclosure and the base. The superabrasive cutting element is exposed through the at least one cutting opening in the enclosure. The superabrasive cutting element may be axially compressed between the base and the enclosure.

In an embodiment, a cutting element assembly includes an enclosure defining a recess, at least one cutting opening, and a longitudinal axis. The superabrasive cutting element further includes a base disposed in the recess, and one or more superabrasive cutting elements disposed in the recess between the enclosure and the base. The one or more superabrasive cutting elements are exposed through the at least one cutting opening and are also rotatable about the longitudinal axis.

In an embodiment, a cutting element assembly includes a base, a superabrasive cutting element positioned adjacent to the base and having at least one through hole extending thicknesswise therethrough, and a fastener. The fastener is inserted through the at least one through hole to mechanically connect the base to the superabrasive cutting element. In some embodiments, the base may be a separate structure that may be, for example, brazed to a drill bit body of a rotary drill bit. In other embodiments, a portion of the drill bit body of a rotary drill bit may serve as the base to which the superabrasive cutting element is directly fastened.

Other embodiments include methods of manufacturing and using the disclosed cutting element assemblies, and applications utilizing the disclosed cutting element assemblies in various articles and apparatuses, such as rotary drill bits, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Some embodiments of the invention relate to cutting element assemblies including a superabrasive cutting element that may be axially compressed to enhance the damage tolerance thereof, enclosed in an enclosure that exposes the superabrasive cutting element therethrough, enclosed in an enclosure that restricts rotation of the superabrasive cutting element, or combinations of the foregoing. Additionally, some embodiments of the invention relate to cutting element assemblies in which a superabrasive cutting element is mechanically fastened to a base, such as a substrate or directly to a bit body of a rotary drill bit. Some embodiments of the invention also relate to cutting element assemblies including one or more superabrasive cutting elements that are rotatable about a longitudinal axis of the cutting element assembly, that may be axially compressed to enhance the damage tolerance thereof, that may be enclosed in an enclosure that exposes the superabrasive cutting element therethrough, or combinations of the foregoing. The disclosed cutting element assemblies may be used in a variety of applications, such as rotary drill bits, machining equipment, and other articles and apparatuses.

Figure 1:
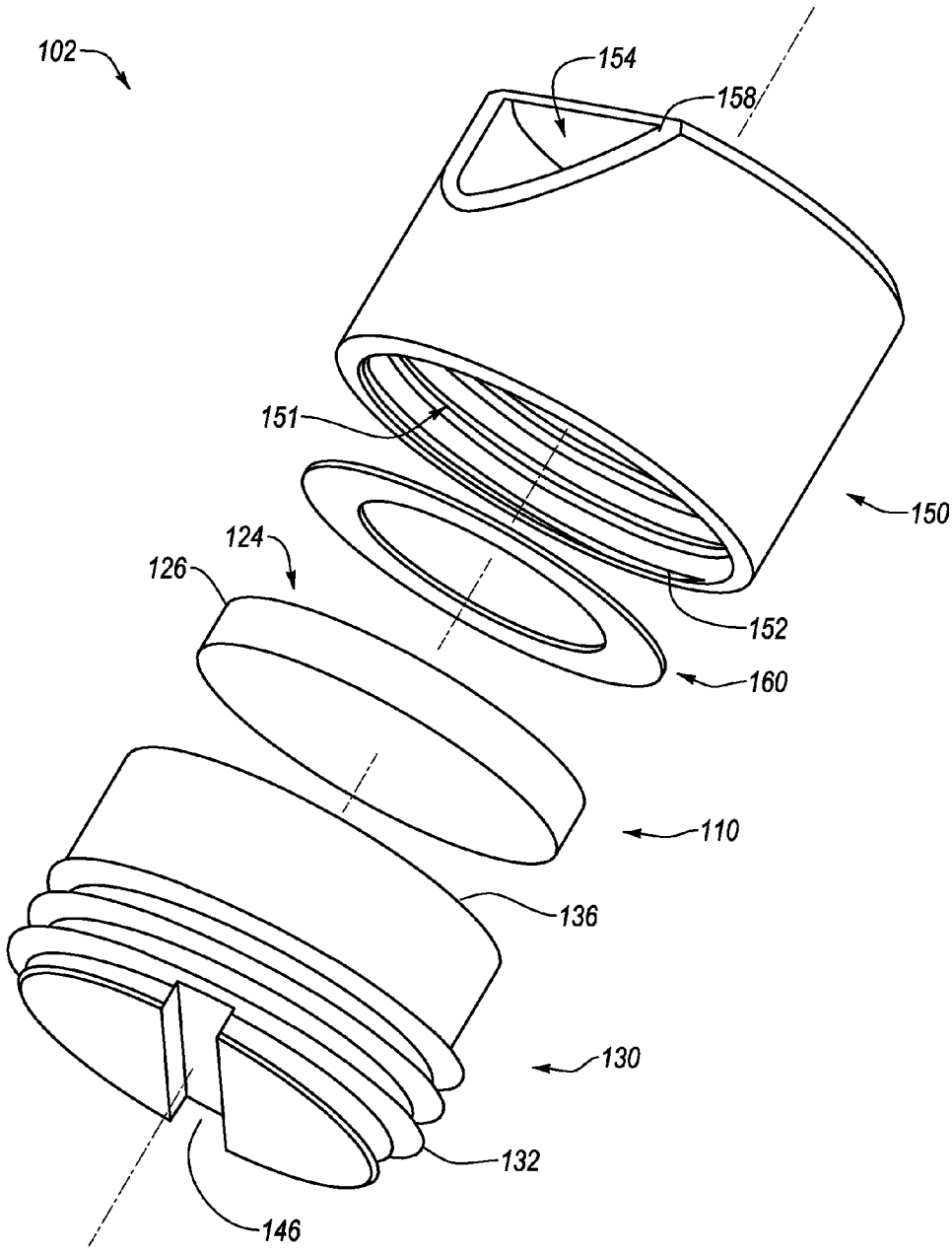
FIG. 1 is an exploded isometric view of an embodiment of a cutting element assembly.
Figure 2:
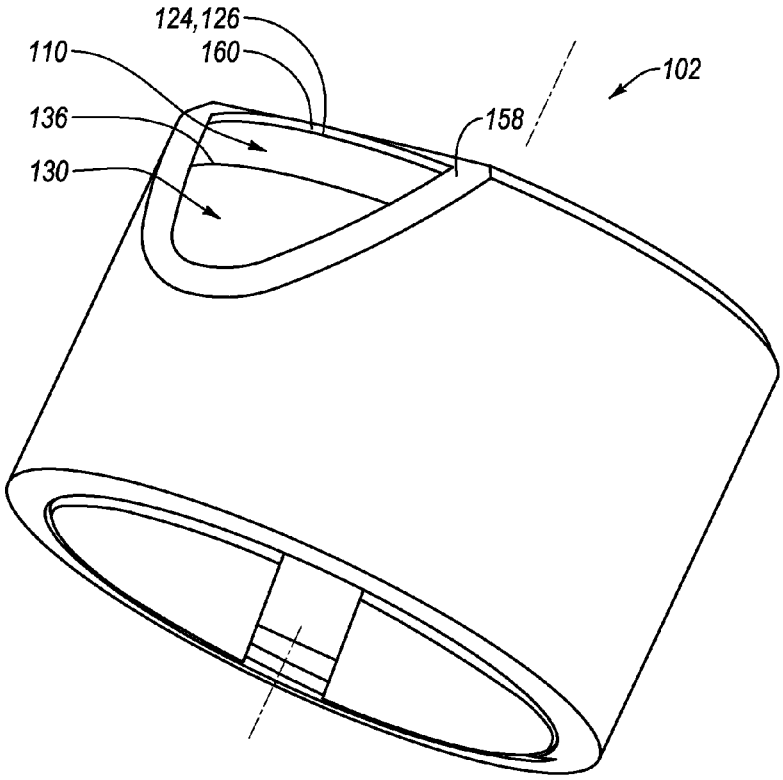
FIG. 2 is an assembled isometric view of the cutting element assembly shown in FIG. 1.

Referring generally to FIGS. 1 and 2, FIG. 1 is an exploded isometric view of an embodiment of a cutting element assembly 102 and FIG. 2 is an assembled isometric view of the cutting element assembly 102 shown in FIG. 1. The cutting element assembly 102 includes an enclosure 150 defining a recess 151 having a superabrasive cutting element 110 and a base 130 disposed therein. An interfacial surface 136 of the base 130 may abut the superabrasive cutting element 110. The superabrasive cutting element 110 may be compressed against the base 130 and/or may be bonded to the base 130 and/or the enclosure 150 via brazing or an HPHT bonding process. In embodiments in which the superabrasive cutting element 110 is not bonded to the base 130, delamination of the superabrasive cutting element 110 from the base 130 may be eliminated.

Compressing the superabrasive cutting element 110 against the base 130 may improve the damage tolerance of the superabrasive cutting element 110 by inducing axial compressive stresses in the superabrasive cutting element 110. For example, the axial compressive stresses in the superabrasive cutting element 110 may improve the damage tolerance thereof (e.g., the impact resistance) so that the ability of the superabrasive cutting element 110 to withstand environmental conditions and/or forces applied to the superabrasive cutting element 110 during drilling may be enhanced. Compressing the superabrasive cutting element 110 between the base 130 and the enclosure 150 may also limit and/or prevent axial and/or rotational movement of the superabrasive cutting element 110 during cutting operations. In other embodiments, the compressive stresses applied to the superabrasive cutting element 110 are sufficient to limit and/or prevent axial movement, while allowing the superabrasive cutting element 110 to still rotate about a longitudinal axis of the enclosure 150 during cutting operations. In some embodiments, the axial compressive stresses may be absent or negligible. In further embodiments, the superabrasive cutting element 110 may be interference fit with the enclosure 150 to prevent rotation about the longitudinal axis during cutting operations.

In any of the embodiments disclosed herein, the superabrasive cutting element 110 (or other superabrasive cutting element in embodiments described hereinafter) may be formed from a number of different superabrasive materials, such as PCD, cubic boron nitride, combinations of the foregoing materials, or other superabrasive material. For example, PCD comprises a plurality of directly-bonded-together diamond grains exhibiting diamond-to-diamond bonding therebetween (e.g., $sp^3$ bonding), with a catalyst/infiltrant material disposed in interstitial regions between the bonded diamond grains. For example, the catalyst/infiltrant material may be selected from a metallic material (e.g., iron, nickel, cobalt, copper, silver, tin, aluminum, gadolinium, gold, or alloys of the foregoing metals), a carbonate (e.g., one or more carbonates of Be, Mg, Ca, Sr, Ba, Li, Na, or K and/or sintering by-products thereof), a sulfate (e.g., one or more sulfates of Be, Mg, Ca, Sr, or Ba) and/or derivatives thereof, a hydroxide (e.g., one or more hydroxides of Be, Mg, Ca, Sr, or Ba), elemental phosphorous, a chloride (e.g., one or more chlorides of Li, Na, or K), elemental sulfur, a polycyclic aromatic hydrocarbon (e.g., naphthalene, anthracene, pentacene, perylene, coronene, derivatives of the foregoing, or combinations of the foregoing) and/or derivatives thereof, a chlorinated hydrocarbon (e.g., dichloromethane; 1,1,1-tricholorethane; derivatives of the foregoing; or combinations of the foregoing) and/or derivatives thereof, a semiconductor material (e.g., germanium or a germanium alloy), and combinations of the foregoing. In some embodiments, the catalyst/infiltrant material of the PCD may be fully or at least partially removed via, for example, acid leaching to form a so-called thermally stable PCD element ("TSP").

In embodiments where the superabrasive cutting element 110 is bonded to the base 130, the superabrasive cutting element 110 may be integrally formed with the base 130, such as by sintering diamond powder on a cobalt-cemented tungsten carbide base in an HPHT process, or preformed and bonded to the base 130 by brazing or another HPHT bonding process.

The enclosure 150 and/or base 130 may be formed of various materials. For example, the enclosure 150 and/or base 130 may be formed of a cobalt-chromium alloy (e.g., Stellite®, etc.), cemented carbide materials (e.g., cobalt-cemented tungsten carbide), toughened ceramics, tungsten-cobalt alloys, steel, other materials, or combinations thereof. In embodiments where both the enclosure 150 and the base 130 are formed of Stellite®, the combination of the base 130 and the enclosure 150 are suitably strong to induce relatively larger axial compressive stresses in the superabrasive cutting element 110 than materials like steel.

The enclosure 150 that houses the superabrasive cutting element 110 may include at least one cutting opening 154 through which a portion of the superabrasive cutting element 110 is exposed. The at least one cutting opening 154 may expose a portion of an outer surface 124 and a cutting edge 126 of the superabrasive cutting element 110 to facilitate cutting of a subterranean formation or other surface. It is noted that the enclosure 150 is shown in FIGS. 1 and 2 with one cutting opening 154. However, the enclosure 150 may include more than one of the cutting openings 154.

The cutting opening 154 may be defined by an edge 158. The edge 158, shown in FIGS. 1 and 2, is generally planar. In other words, the edge 158 may be formed by a single straight cut or grind at an angle to the longitudinal axis of the enclosure 150. In other embodiments, the edge 158 may be otherwise shaped or formed.

The enclosure 150 may include an interior engaging surface 152. The engaging surface 152 may be configured to cooperate with the base 130 to retain the superabrasive cutting element 110 against the interfacial surface 136 of the base 130. The base 130 may be likewise configured to cooperate with the engaging surface 152. In the illustrated embodiment, the base 130 may include an engaging surface 132.

In the illustrated embodiment, the engaging surface 152 of the enclosure 150 and the engaging surface 132 of the base 130 may include threads for threadly connecting the enclosure 150 to the base 130. In other embodiments, the engaging surfaces 132, 152 may include the same or different types of engaging surfaces and/or may include other engaging features, such as press-fitting surfaces, snap fitting surfaces, at least one connection protrusion (shown as element 458 in FIG. 6), slidably engaging surfaces, other engaging features, or combinations thereof. The threads of the engaging surface 152 are shown in FIGS. 1 and 2 extending along only a portion of the engaging surface 152. In some embodiments, the threads that extend along a portion of the engaging surface 152 (i.e. less than the entirety of the engaging surface 152) and the portion without threads may exhibit different interior diameters. In other embodiments, the entire engaging surface 152 may include threads, and the cutting opening 154 may remove and/or interrupt a portion of the threads.

The base 130 may further include a driving slot 146 or other feature located on a back end thereof that may facilitate applying stresses to the superabrasive cutting element 110. For example, in embodiments where the engaging surface 132 of the base 130 and the engaging surface 152 of the enclosure 150 are threaded, the driving slot 146 may be used to thread the base 130 and the enclosure 150 together using, for example, a screwdriver in order to compress the superabrasive cutting element 110 therebetween to a sufficient level. In further embodiments, the torque applied between the enclosure 150 and the base 130 may be specified and/or monitored when assembling the cutting element assembly 102 for repeatability during manufacture and/or to help prevent overloading the superabrasive cutting element 110. For example, the torque may be about 10 to about 150 foot-pounds ("ft·lbs"), such as about 10 ft·lbs to about 90 ft·lbs, about 50 ft·lbs to about 85 ft·lbs, or about 75 ft·lbs to about 100 ft·lbs. The resultant axial compressive stresses applied to the superabrasive cutting element 110 may be about 20 percent to about 90 percent of the compressive fracture strength of the superabrasive cutting element 110 as measured in a bend test, such as about 30 percent to about 75 percent or about 35 percent to about 50 percent of the superabrasive cutting element 110.

The cutting assembly 102, in some embodiments, may include a compressible element 160. The compressible element 160 may be formed of copper, a copper alloy, or other compressible material such as a soft metal or alloy. The compressible element 160 may be disposed between the enclosure 150 and the superabrasive cutting element 110 and/or between the superabrasive cutting element 110 and the base 130. The embodiment is shown in FIGS. 1 and 2 with only one compressible element 160, though more than one or no compressible element 160 may be used.

The compressible element 160 may be used to direct the induction of stresses in the superabrasive cutting element 110. For example, as shown in FIGS. 1 and 2 the compressible element 160 may have a ring shape that has approximately the same outer diameter as an outer diameter of the superabrasive cutting element 110, which may induce compressive stresses at or near the edge of the superabrasive cutting element 110 to enhance the damage tolerance of the edge or edge region of the superabrasive cutting element 110.

The compressible element 160 may be otherwise sized and/or shaped. For instance, the compressible element 160 may be smaller and/or larger than the superabrasive cutting element 110, may have a similar and/or different shape than the superabrasive cutting element 110, may have a uniform and/or non-uniform thickness and/or cross-section, may have other variations, or combinations thereof. The variations in the compressible element 160 may facilitate specific induction of stresses at desired locations and/or in desired proportions with respect to areas where the compressible element 160 may not contact the superabrasive cutting element 110.

The interfacial surface 136 of the base 130, against which the superabrasive cutting element 110 may be retained, may directly abut the superabrasive cutting element 110, as shown in FIGS. 1 and 2. In other embodiments, one or more of the compressible elements 160 and/or a spacing element may separate the superabrasive cutting element 110 from the base 130.

The base 130 is illustrated in FIGS. 1 and 2 as being a separate component from a bit body of a rotary drill bit, and the enclosure 150 would be brazed to the bit body to secure the cutting element assembly 102 thereon. However, in other embodiments, the base 130 may be integrally formed as part of the bit body. In such an embodiment, the cutting element assembly 102 may be formed connecting the enclosure 150 with the superabrasive cutting element 110 disposed therein to the base 130. In a further embodiment, the at least part of the enclosure 150 may form part of the bit body, and the cutting element assembly 102 may assembled on the bit body.

Figure 3:
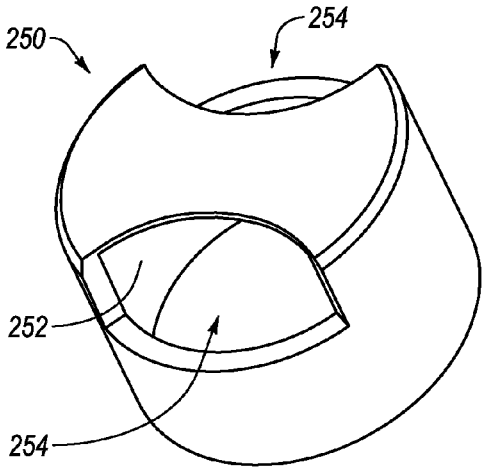
FIG. 3 is an isometric view of an embodiment of an enclosure.

FIG. 3 is an isometric view of an embodiment of an enclosure 250. Like the enclosure 150, the enclosure 250 may be used to house and retain a superabrasive cutting element (such as superabrasive cutting element 110 shown in FIGS. 1 and 2) against a base (such as base 130 shown in FIGS. 1 and 2). The enclosure 250 may include at least one cutting opening 254 and is shown in FIG. 3 with two cutting openings 254. The cutting openings 254 may expose the superabrasive cutting element 110 therethrough to facilitate cutting of a subterranean formation or other surface for cutting. By having the superabrasive cutting element 110 exposed through two or more cutting openings 254, when the portion of the superabrasive cutting element 110 exposed through one of the cutting openings 254 is worn and/or damaged, the enclosure 250 including the superabrasive cutting element 110 therein may be detached from a drill bit body and rotated so the unworn portion thereof exposed through the other cutting opening 254 may be used. For example, the enclosure 250 may be un-brazed from a drill bit body, rotated, and re-brazed to the drill bit body in the rotated orientation.

The cutting openings 254 may extend inwardly further toward a longitudinal axis of the enclosure 250 than the cutting openings 154 shown in FIGS. 1 and 2. Thus, the amount of the superabrasive cutting element 110 that is exposed through one of the cutting openings 254 may be larger than the amount of the superabrasive cutting element 110 exposed through the single cutting opening 154 of the enclosure 150. However, the amount of the superabrasive cutting element 110 that is exposed through the cutting openings 254 may vary. For example, the cutting openings 254 may expose all but a portion of an outer surface (shown as 124 in FIG. 1) of the superabrasive cutting element 110.

The enclosure 250 may include an engaging surface 252. The engaging surface 252 may be configured to cooperate with a base (such as the base 130 shown in FIGS. 1 and 2) to retain the superabrasive cutting element 110 against the base. In the illustrated embodiment, the engaging surface 252 of the enclosure 250 may be sized and shaped with respect to a corresponding base to press-fit, braze, solder, glue, or weld the base and/or superabrasive cutting element and the enclosure 250 together. In other embodiments, the engaging surface 252 may include the same or different types of engaging surfaces as a corresponding base and/or may include other engaging features, such as threaded surfaces, snap fitting surfaces, at least one connection protrusion (shown as element 458 in FIG. 6), slidably engaging surfaces, other engaging features, or combinations thereof.

Figure 4:
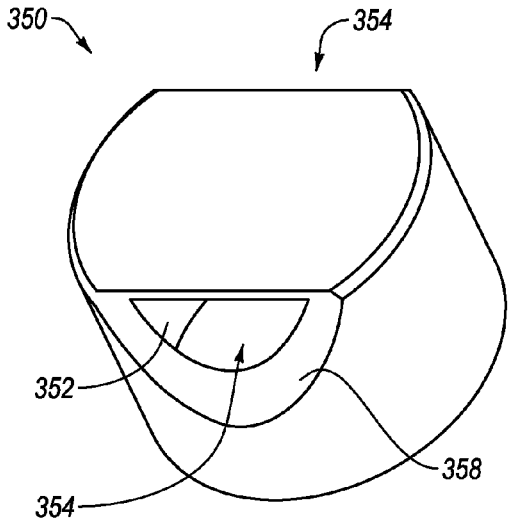
FIG. 4 is an isometric view of another embodiment of an enclosure.

FIG. 4 is an isometric view of a further embodiment of an enclosure 350. The enclosure 350 may be used to house and retain a superabrasive cutting element against a base (such as the superabrasive cutting element 110 and the base 130 shown in FIGS. 1 and 2). The enclosure 350 may include at least one cutting opening 354 and is shown in FIG. 3 with two cutting openings 354. The cutting openings 354 may expose the superabrasive cutting element 110 to facilitate cutting of a subterranean formation or other surface for cutting.

The cutting openings 354 are similar to the cutting openings 154 shown in FIGS. 1 and 2. The cutting opening 354 may be defined by an edge 358. The edge 358, shown in FIG. 3, is generally planar. In other words, the edge 358 may be formed by a single straight cut or by grinding at an angle to the longitudinal axis of the enclosure 350. In other embodiments, the edge 358 may be otherwise shaped or formed.

The enclosure 350 may include an engaging surface 352. The engaging surface 352 may be configured to cooperate with a base (such as the base 130 shown in FIGS. 1 and 2) to retain a superabrasive cutting element 110 against the base. In the illustrated embodiment, the engaging surface 352 of the enclosure 350 may be sized and shaped with respect to a corresponding base to press-fit, braze, solder, glue, or weld the base and/or superabrasive cutting element to the enclosure 350 together. For example, an inner diameter of the enclosure 350 may be larger than an outer diameter of its corresponding base. In other embodiments, the engaging surface 352 may include the same or different types of engaging surfaces as a corresponding base and/or may include other engaging features, such as threaded surfaces, snap-fitting surfaces, at least one connection protrusion (shown as 458 in FIG. 6), other engaging features, or combinations thereof.

Figure 5:
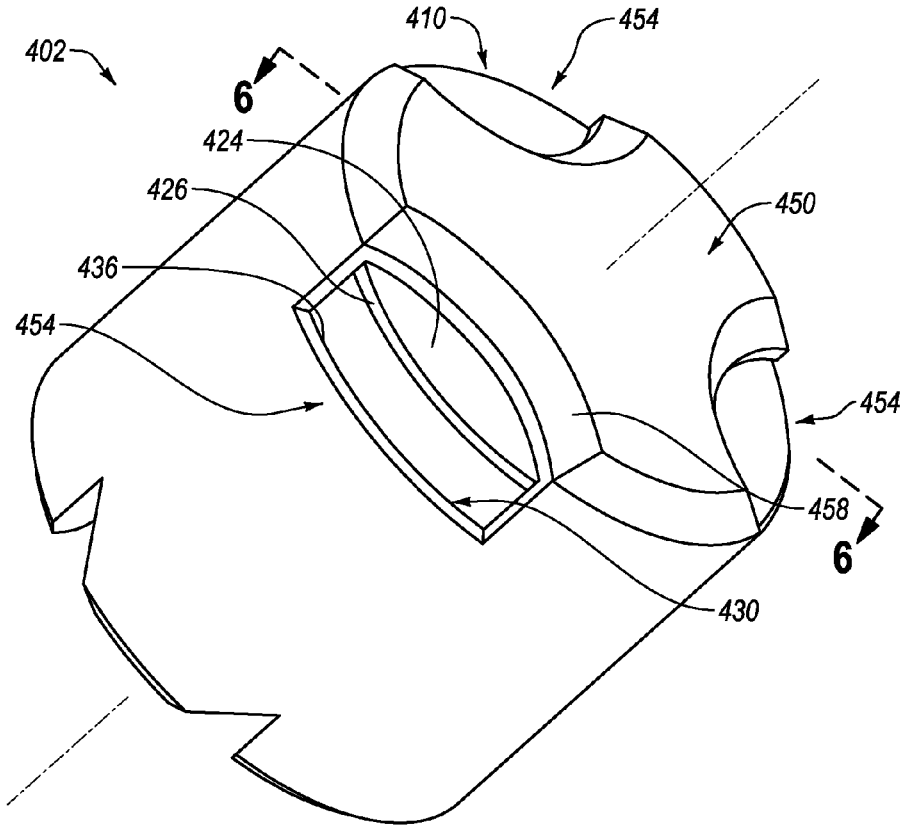
FIG. 5 is an isometric view of another embodiment of a cutting element assembly with three cutting openings.
Figure 6:
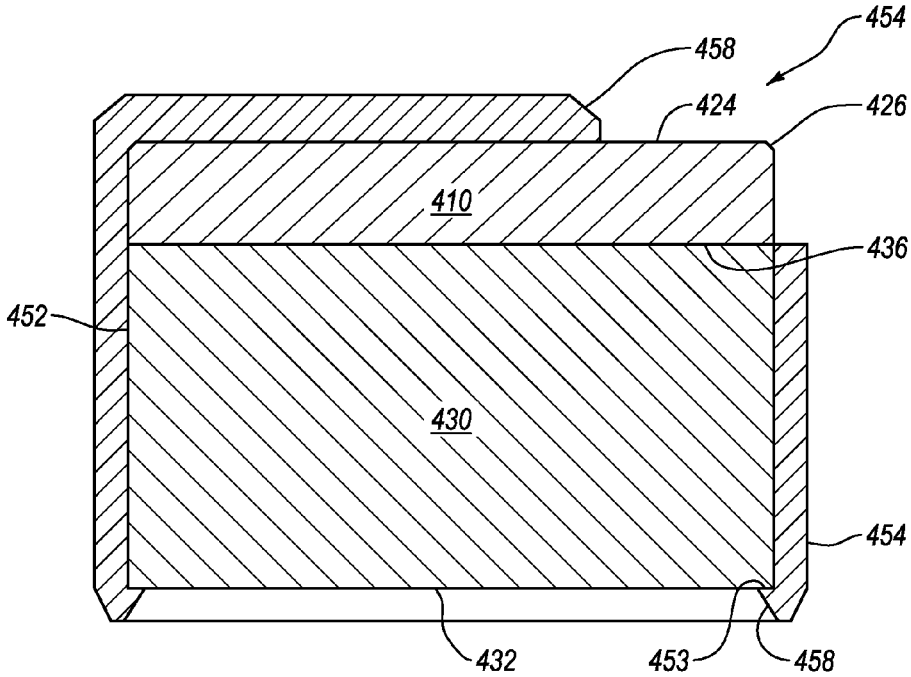
FIG. 6 is a side cross-sectional view of the enclosure of FIG. 5 taken along line 6-6 thereof.

Referring generally to FIGS. 5 and 6, FIG. 5 is an isometric view of another embodiment of a cutting element assembly 402 with three cutting openings 454 and FIG. 6 is a side cross-sectional view of the enclosure 450 of FIG. 5. The enclosure 450 of the cutting element assembly 402 defines a recess 452 (see FIG. 6) having a superabrasive cutting element 410 and a base 430 disposed therein. The superabrasive cutting element 410 may abut an interfacial surface 436 of the base 430 (see FIG. 6). The superabrasive cutting element 410 may be retained against the base 430 by the enclosure 450 and/or may be bonded to the base 430 via brazing or an HPHT bonding process.

The enclosure 450 that houses and retains the superabrasive cutting element and the base 430 may include at least one cutting opening 454. As shown most clearly in FIG. 5, the at least one cutting opening 454 may expose a portion of an outer surface 424 and a cutting edge 426 of the superabrasive cutting element 410 to facilitate cutting of a subterranean formation or other surface for cutting. The enclosure 450 is shown in FIG. 5 with three cutting openings 454. However, the enclosure 450 may include more or fewer cutting openings 454.

The cutting opening 454 may be partially defined by an edge 458. The edge 458, shown in FIGS. 5 and 6, is generally perpendicular to the outer surface 424 of the superabrasive cutting element 410 near the bottom and generally chamfered near the top of the cutting opening 454. In other embodiments, the edge 458 may be otherwise shaped or formed.

The enclosure 450 may include an engaging surface 453. The engaging surface 453 may be configured to cooperate with the base 430 to retain the superabrasive cutting element 410 against the interfacial surface 436 of the base 430. The base 430 may be likewise configured to cooperate with the engaging surface 453. In the illustrated embodiment, the base 430 may include an engaging surface 432.

The engaging surface 452 of the enclosure 450 may include at least one connection member 458. In the illustrated embodiment, the connecting member 458 may be configured as a tab extending radially inwardly that may snap fit with the engaging surface 453. The engaging surface 432 of the base 430 may simply be the bottom surface of the base 430, which may engage the connection member 458 to thereby retain and axially compress the superabrasive cutting element 410 against the base 430 so that the damage tolerance of the superabrasive cutting element 410 is enhanced. As such, the enclosure 450 may be made of a suitably strong and ductile material, such as cobalt-chromium alloys (e.g., Stellite® or any other cobalt-chromium alloy), cemented carbide materials (e.g., cobalt-cemented tungsten carbide), tungsten-cobalt alloys, steel, other materials, or combinations thereof. However, the base 430 and/or the superabrasive cutting element 410 may still be brazed, soldered, glued, or welded to the enclosure 450 in addition to the snap fit, if desired or needed. Further, in some embodiments, the axial compression of the superabrasive cutting element 410 may be absent or minimal depending on the combined height of the superabrasive cutting element 410 and the base 430 relative to the length of the enclosure 450. In some embodiments, the cutting element assembly 402 may be structured to prevent rotation of superabrasive cutting element 410 during use in a subterranean drill bit.

The interfacial surface 436 of the base 430 may directly abut the superabrasive cutting element 410, as shown in FIGS. 5. In other embodiments, a compressible element (e.g., the compressible element 160 in FIGS. 1 and 2) and/or a spacing element may separate the superabrasive cutting element 410 from the base 430.

Figure 7:
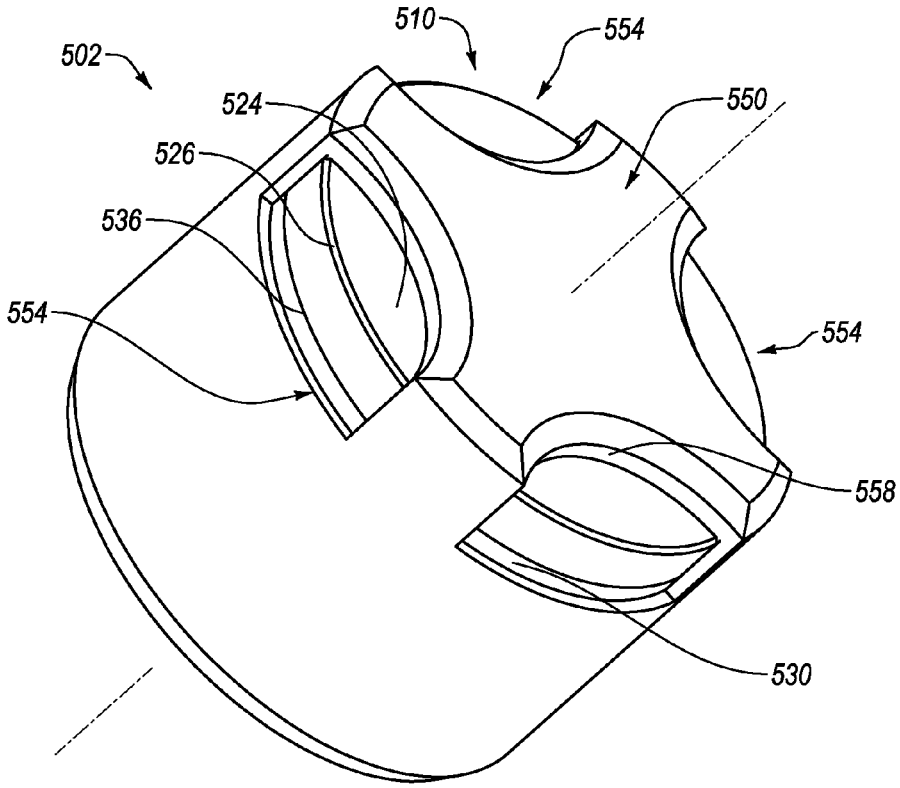
FIG. 7 is an isometric view of a still further embodiment of a cutting element assembly with four cutting openings.

FIG. 7 is an isometric view of a still further embodiment of a cutting element assembly 502 with four cutting openings 554. The cutting element assembly 502 includes an enclosure 550 defining a recess (not labeled) having a superabrasive cutting element 510 and a base 530 disposed therein. An interfacial surface 536 of the base 530 may at least partially abut against the superabrasive cutting element 510. The superabrasive cutting element 510 may be retained against the base 530 and between the base 530 and the enclosure 550 and/or may be bonded to the base 530 and/or the enclosure 550 via brazing or an HPHT bonding process.

The enclosure 550 that houses and retains the superabrasive cutting element 510 and the base 530 may include at least one cutting opening 554. The at least one cutting opening 554 may expose a portion of an outer surface 524 and a cutting edge 526 of the superabrasive cutting element 510 therethrough to facilitate cutting of a subterranean formation or other surface for cutting. The enclosure 550 is shown in FIG. 7 with four cutting openings 554. However, the enclosure 550 may include more or fewer cutting openings 554.

The cutting opening 554 may be partially defined by an edge 558. The edge 558, shown in FIG. 5, is generally perpendicular to the outer surface 524 of the superabrasive cutting element 510 near the bottom and generally chamfered near the top. In other embodiments, the edge 558 may be otherwise shaped or formed.

The enclosure 550 may include an engaging surface (not shown). The engaging surface may be configured to cooperate with the base 530 to retain the superabrasive cutting element 510 against the interfacial surface 536 of the base 530. The base 530 may be likewise configured to cooperate with the engaging surface. In the illustrated embodiment, the base 530 may include an engaging surface (not shown). The engaging surface 552 of the enclosure 550, as shown in FIG. 7, may be sized and shaped with respect to base 530 to press-fit the base 530 and the enclosure 550 together, weld the base 530 and the enclosure 550 together, braze the base 530 and the enclosure 550 together, glue the base 530 and the enclosure 550 together, solder the base 530 and the enclosure 550 together, thread the base 530 and the enclosure 550 together, or combinations of the foregoing. In other embodiments, the engaging surfaces may include the same or different types of engaging surfaces, such as at least one connection protrusion (shown as 458 in FIG. 6), other engaging features, or combinations thereof.

The interfacial surface 536 of the base 530, against which the superabrasive cutting element 510 may be retained, may directly abut the superabrasive cutting element 510, as shown in FIG. 7. In other embodiments, a compressible element (e.g., the compressible element 160 in FIGS. 1 and 2) and/or a spacing element may separate the superabrasive cutting element 510 from the base 530.

Figure 8:
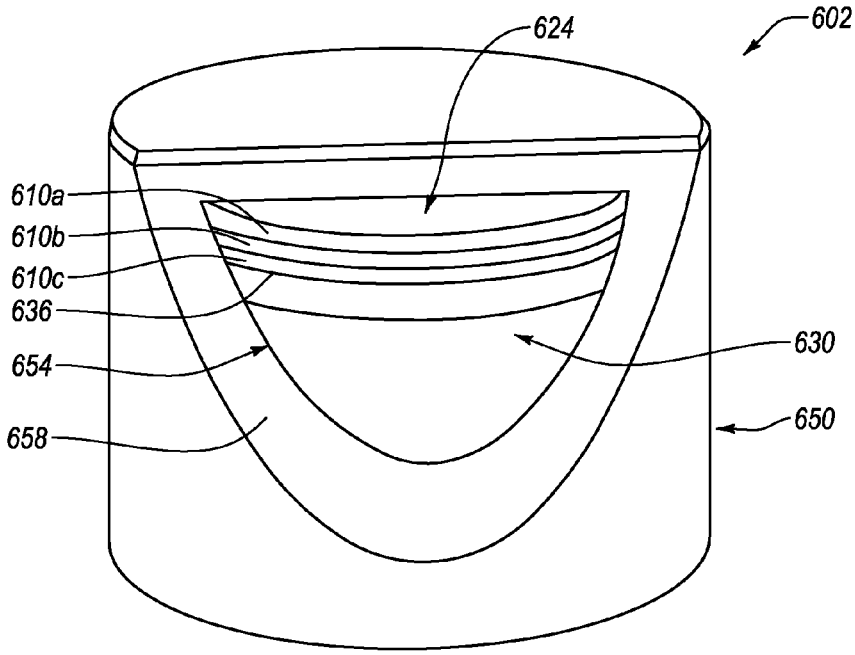
FIG. 8 is an assembled isometric view of a cutting element assembly according to yet another embodiment.
Figure 9:
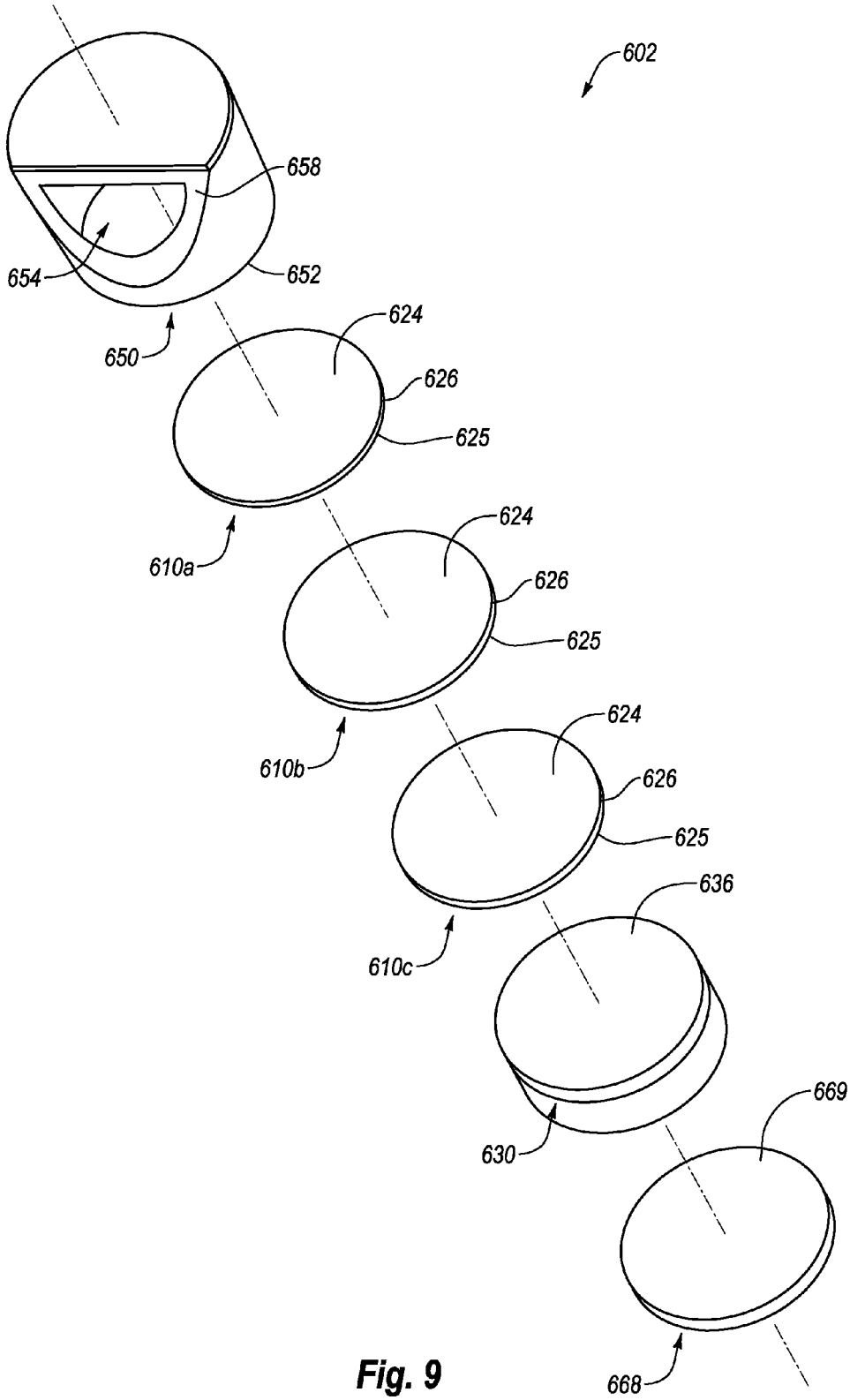
FIG. 9 is an exploded isometric view of the cutting element assembly of FIG. 8.

Referring generally to FIGS. 8 and 9, FIG. 8 is an assembled isometric view of a cutting element assembly 602 and FIG. 9 is an exploded isometric view of the cutting element assembly 602 of FIG. 8. The cutting element assembly 602 includes an enclosure 650 defining a recess (not labeled) having a plurality of superabrasive cutting elements 610*a*-610*c* in the form of respective circular disks and a base 630 disposed therein. Three of the superabrasive cutting elements 610 are shown the illustrated embodiment. However, in other embodiments, less or more than three of the superabrasive cutting elements 610 may be provided. The superabrasive cutting elements 610*a*-610*c* may be retained against an interfacial surface 636 of the base 630 by the enclosure 650. Each of the superabrasive cutting elements 610*a*-610*c* includes an upper surface 624, a lower surface, and a cutting edge 626. The base 630 may include a superabrasive compact, such as PDC. In other words, the base 630 may include a PCD table that is, for example, integrally formed on and bonded to a substrate. The substrate may be formed from a cemented carbide material, such as cobalt-cemented tungsten carbide or other suitable cemented carbide material.

The enclosure 650 that houses the superabrasive cutting element 610 and the base 630 may include at least one cutting opening 654. As shown in FIGS. 8 and 9, the at least one cutting opening 654 may expose a portion of the superabrasive cutting elements 610*a*-610*c* and the base 630 therethrough to facilitate cutting of a subterranean formation during drilling operations. The enclosure 650 is shown in FIGS. 8 and 9 with one cutting opening 654. However, the enclosure 650 may include more cutting openings 654. The cutting opening 654 may be defined an edge 658. The edge 658, shown in FIGS. 8 and 9, is generally planar. In other words, the edge 658 may be formed by a single straight cut or grind at an angle to the longitudinal axis of the enclosure 650. In other embodiments, the edge 658 may be otherwise shaped or formed.

The upper surface 624 and the lower surface 626 of each of the superabrasive cutting elements 610*a*-610*c* and the interfacial surface 636 of the base 630 may each be polished to exhibit a substantially mirror finish or other smooth finish. By polishing the upper surface 624 and the lower surface 626 of each of the superabrasive cutting elements 610*a*-610*c* and the interfacial surface 636 of the base 630, the superabrasive cutting elements 610*a*-610*c* and the base 630 may rotate freely about the longitudinal axis of the cutting element assembly 602 to help average the amount of wear on the superabrasive cutting elements 610*a*-610*c* and the base 630 during cutting operations. The superabrasive cutting elements 610*a*-610*c* may function as the primary cutting structures, with the base 630 serving as a back-up cutting structure should the wear flat extend all the way to the base 630.

As shown in FIG. 9, the cutting element assembly 602 may include a backing element 668. The backing element 668 may be used to retain the base 630 and the superabrasive cutting elements 610*a*-610*c* within the enclosure 650. For example, the backing element 668 may be bonded to the enclosure 650 and/or base 630 in addition to or in place of the enclosure 650 and the base 630 being bonded together. In some embodiments, the combination of the enclosure 650 and the backing element 668 may apply axial compressive stresses to the superabrasive cutting element 610*a*-610*c* having any of the axial compressive stress values disclosed herein.

The backing element 668 may be bonded to the enclosure 650 to retain the superabrasive cutting elements 610*a*-610*c* and the base 630 in the enclosure 650. For example, the backing element 668 may be inserted into the enclosure 650 to compress the superabrasive cutting element 610 and the base 630 between an interior of the enclosure 650 and the backing element 668, and bonded to the enclosure 650 via brazing, soldering, gluing, welding, or other suitable joining process in the compressed configuration. In other embodiment, the backing element 668 may threadly connected to an interior of the enclosure 650. The backing element 668 may be made of similar or dissimilar materials than the enclosure 650 and/or the base 630, such as cobalt-chromium alloys (e.g., Stellite® or other cobalt-chromium alloy), cemented carbide materials (e.g., cobalt-cemented tungsten carbide), tungsten-cobalt alloys, steel, other materials, or combinations thereof. The material of the backing member 668 may be selected to ensure sufficient strength to withstand forces generated during the bonding process and generated during cutting operations.

As shown in FIG. 9, the backing element 668 may have an outer diameter dimensioned to be received by the enclosure 650 (i.e., slightly smaller than an inner diameter of the enclosure 650). However, in another embodiment, the backing element 608 may have substantially the same outer diameter and/or footprint as an outer diameter and/or footprint of the enclosure 650. In another embodiment, the backing element 668 may be configured as a shallow cup that receives a portion of the enclosure 650.

In some embodiments where the enclosure 650 slidably engages the base 630, the enclosure 650 and base 630 may be bonded together. For example, the enclosure 650 and base 630 may be welded, adhesively bonded, brazed, soldered, press-fit together, otherwise bonded, or combinations thereof. In such an embodiment, only the superabrasive cutting elements 610*a*-610*c* would rotate about the longitudinal axis during cutting operations and the base 630 would remain stationary.

In a further embodiment, one or more polished superabrasive spacer elements (e.g., one or more PCD disks) may be disposed between the base 630 and the backing element 668 along with the base 630 being disposed between one or more of the superabrasive cutting elements 610 and the one or more polished superabrasive spacer elements. In such an embodiment, the one or more polished superabrasive spacer elements further helps the one or more superabrasive cutting elements 610 and the base 630 rotate freely about the longitudinal axis during cutting operations.

The interfacial surface 636 of the base 630 may indirectly abut the superabrasive cutting element 610*a*. For example, the superabrasive cutting element 610*a* may be spaced from the interfacial surface 636 by the superabrasive cutting elements 610*b* and 610*c* or more than two or less than two spacing elements may be used. Instead of using the superabrasive cutting elements 610*b* and 610*c*, compressible or substantially incompressible spacing elements may be used. Although the superabrasive cutting elements 610*a*-610*c* are described above as being rotatable, in other embodiments, one, two or all of the superabrasive cutting elements 610*a*-610*c* may be configured, in combination with interior geometry of the enclosure 650, to prevent rotation about the longitudinal axis of the enclosure 650 during cutting operations. For example, one, two or all of the superabrasive cutting elements 610*a*-610*c* may include a notch, flat, or other feature configured to prevent rotation in combination with the enclosure 650. However, in other embodiments, one, two or all of the superabrasive cutting elements 610*a*-610*c* may exhibit a circular-disk configuration and rotation thereof may be restricted due to the configuration of the enclosure 650 and the superabrasive cutting elements 610*a*-610*c* (e.g., being interference fit with the enclosure 650), due to the superabrasive cutting elements 610*a*-610*c* being brazed to the interior of the enclosure 650, due to axial compression between the enclosure 650 and other components, or combinations of the foregoing.

Figure 10:
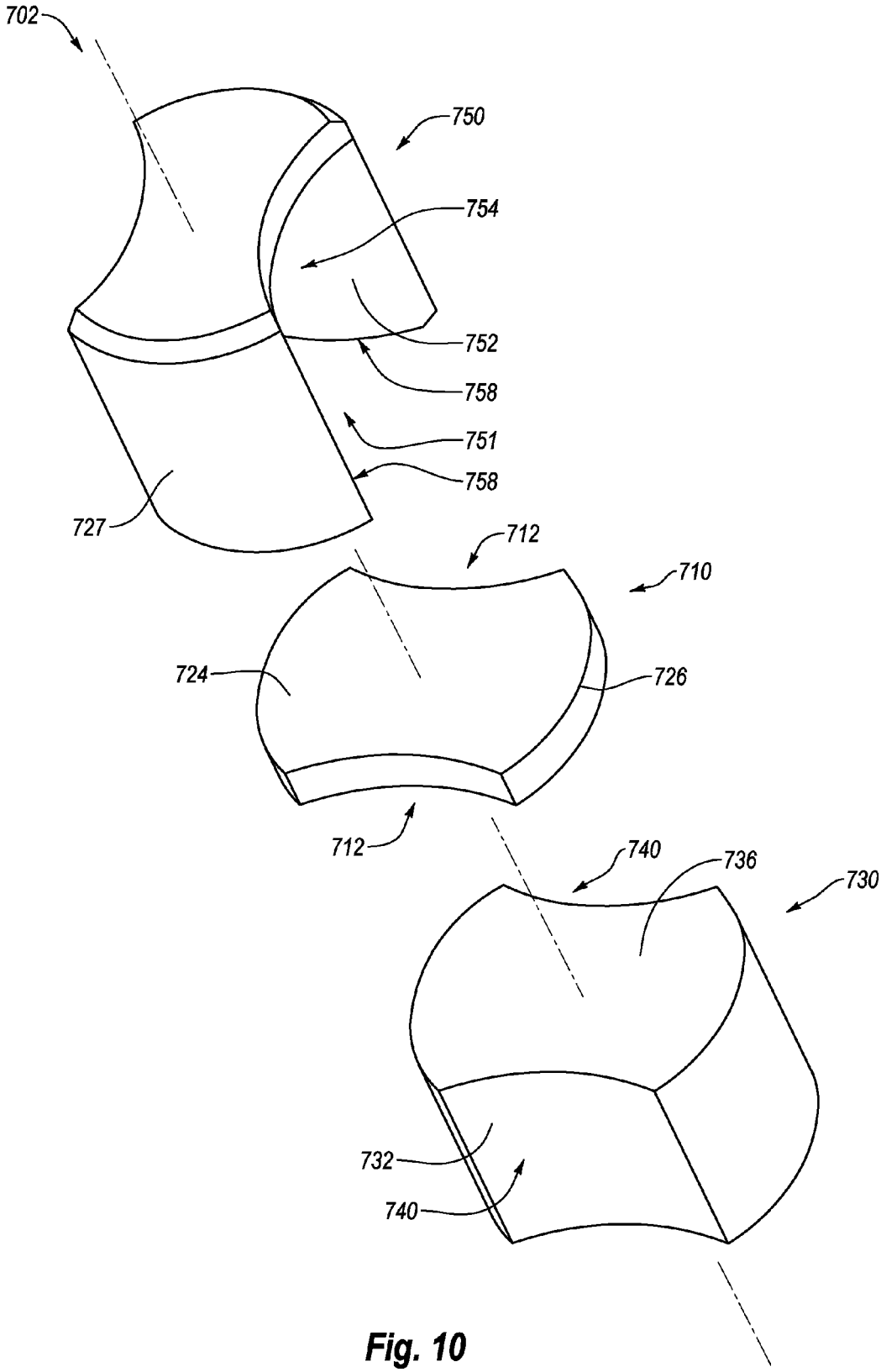
FIG. 10 is an exploded isometric view of an embodiment of a cutting element assembly configured to limit axial rotation of a superabrasive cutting element.

FIG. 10 is an exploded isometric view of an embodiment of a cutting element assembly 702 configured to limit axial rotation of a superabrasive cutting element. The cutting element assembly 702 includes an enclosure 750 defining a recess 751 having a superabrasive cutting element 710 and a base 730 disposed therein. The superabrasive cutting element 710 includes an outer surface 724 and a cutting edge 726. The cutting edge 726 and an exterior 727 of the enclosure 750 may substantially define a circumference of a circle (e.g., a radius of the cutting edge 726 may substantially match an outer radius of the enclosure 750). An interfacial surface 736 of the base 730 may abut the superabrasive cutting element 710. The superabrasive cutting element 710 may be retained against the base 730 by the enclosure 750 and/or may be bonded to the base 730 via brazing or an HPHT bonding process.

The enclosure 750 that houses the superabrasive cutting element 710 and the base 730 may include at least one cutting opening 754. The at least one cutting opening 754 may expose a portion of the outer surface 724 and the cutting edge 726 of the superabrasive cutting element 710 to facilitate cutting of a subterranean formation or other surface for cutting. The enclosure 750 is shown in FIG. 10 with two cutting openings 754. However, the enclosure 750 may include one or more cutting openings 754.

The enclosure 750 may include an engaging surface 752. The engaging surface 752 may be configured to cooperate with the base 730 to retain the superabrasive cutting element 710 against the interfacial surface 736 of the base 730. The base 730 may be likewise configured to cooperate with the engaging surface 752. The base 730 may include an engaging surface 732.

In the illustrated embodiment, the enclosure 750 may include one or more connecting members 758 (e.g., arms) that may extend from an upper portion of the enclosure 750. The engaging surface 752 of the enclosure 750 may be located on an inner surface of the connecting member 758.

The base 730 may include one or more connecting channels 740. The base 730 may include an engaging surface 732 on an inner surface of the connecting channel 740. The connecting channel 740 may be configured to receive the connecting member 758 to secure the base 730 to the enclosure 750. For example, the connecting member 758 of the enclosure 750 may be sized and/or shaped to press-fit with the connecting channel 740 of the base 730. In other words the engaging surface 732 on the inner surface of the connecting channel 740 of the base 730 may engage with the engaging surface 752 on an inner surface of the connecting member 758 of the enclosure 750. In other embodiments, each connecting member 758 may be brazed, soldered, glued, or welded to the engaging surface 732 of a corresponding connecting channel 740.

The connecting members 758 may limit the axial rotational freedom of the superabrasive cutting element 710 and the base 730 in the enclosure 750. In other words, the connecting members 758 may abut a periphery 712 of the superabrasive cutting element 710 to thereby limit rotational motion of the superabrasive cutting element 710 about a longitudinal axis of the enclosure 750. In some embodiments, axial compressive stresses induced in the superabrasive cutting element 710 by the combination of the base 730 and the enclosure 750 may limit and/or prevent any axial and/or rotational movement of the superabrasive cutting element 710 when attached to a subterranean drill bit. In other embodiments, the axial compressive stresses in the superabrasive cutting element 710 may be absent or minimal.

The interfacial surface 736 of the base 730 may directly abut the superabrasive cutting element 710, as shown in FIG. 10. In other embodiments, a compressible element (described as 130 in FIGS. 1 and 2) and/or a spacing element may separate the superabrasive cutting element 710 from the base 730. The compressible element and/or spacing element may be shaped to have a similar footprint as the superabrasive cutting element 710 and/or base 730.

Figure 11:
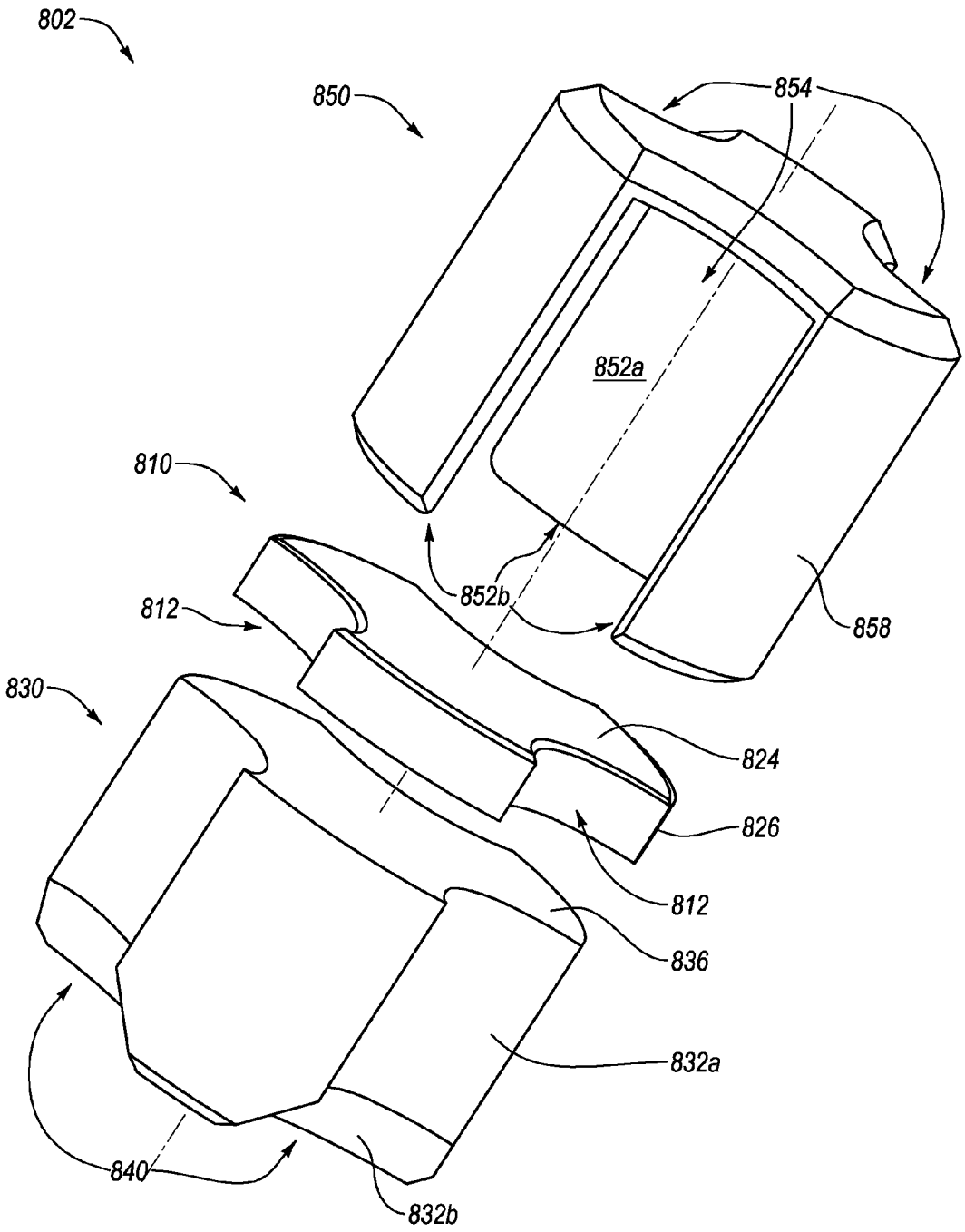
FIG. 11 is an exploded isometric view of another embodiment of a cutting element assembly configured to limit axial rotation of a superabrasive cutting element.

FIG. 11 is an exploded isometric view of another embodiment of a cutting element assembly 802 configured to limit axial rotation of a superabrasive cutting element. The cutting element assembly 802 includes a superabrasive cutting element 810 that may abut an interfacial surface 836 of a base 830. The superabrasive cutting element 810 includes an outer surface 824 and a cutting edge 826. The cutting edge 826 and an exterior of the enclosure 850 may substantially define a circumference of a circle (e.g., a radius of the cutting edge 826 may substantially match an outer radius of the enclosure 850). The superabrasive cutting element 810 may be retained against the base 830 by the enclosure 850 and/or may be bonded to the base 830 and/or the enclosure 850 via brazing or an HPHT bonding process.

The enclosure 850 that houses the superabrasive cutting element 810 and the base 830 may include at least one cutting opening 854. The at least one cutting opening 854 may expose a portion of the outer surface 824 and the cutting edge 826 of the superabrasive cutting element 810 to facilitate cutting of a subterranean formation or other surface for cutting. The enclosure 850 is shown in FIG. 11 with three cutting openings 854. However, the enclosure 850 may include more or fewer cutting openings 854.

The enclosure 850 may include a first engaging surface 852*a* on an inner surface of a connecting member 858 that may extend from an upper portion of the enclosure 850 and/or a second engaging surface 852*b* on a lower portion of the connecting member 858. The first and/or second engaging surfaces 852*a*, 852*b* may be configured to cooperate with the base 830 to retain the superabrasive cutting element 810 against the interfacial surface 836 of the base 830.

The base 830 may be likewise configured to cooperate with the engaging surface 852. The first engaging surface 832*a* on an outer surface of a connecting channel 840 of the base 830 and/or the second engaging surface 832*b* on a lower portion of the connecting channel 840 may be configured to receive and/or retain the enclosure 850 with respect to the base 830. For example, the connecting member 858 of the enclosure 850 may be sized and/or shaped to press-fit with the connecting channel 840 of the base 830. In other words, the first engaging surface 832*a* on the outer surface of the connecting channel 840 of the base 830 may engage with the first engaging surface 852*a* on the inner surface of the connecting member 858 of the enclosure 850. In another example, the second engaging surface 832*b* on the lower portion of the connecting channel 840 may engage with the second engaging surface 852*b* on the lower portion of the connecting member 858. In a further example, the first engaging surface 832*a* and/or the second engaging surface 832*b* of the connecting channel 840 may engage with the first engaging surface 852*a* and/or the second engaging surface 852*b* of the connecting member 858. In other embodiments, the connecting members 858 may be brazed, soldered, glued, or welded to the base 830.

As with the embodiment shown in FIG. 10, the connecting members 858 may limit the axial rotational freedom of the superabrasive cutting element 810 about a longitudinal axis defined by the enclosure 850. The superabrasive cutting element 810 may include at least one connecting opening 812 that may be sized to allow the enclosure 850 to extend over the superabrasive cutting element 810 and engage with the base 830. Thus, the connecting members 858 may abut the connecting openings 812 of the superabrasive cutting element 810 limiting motion of the superabrasive cutting element 810 about a longitudinal axis. In other embodiments, the stresses induced by the retention of the base 830 with respect to the enclosure 850 may limit and/or prevent any axial and/or rotational movement of the superabrasive cutting element 810 when attached to a subterranean drill bit.

The interfacial surface 836 of the base 830 may directly abut the superabrasive cutting element 810, as shown in FIG. 11. In other embodiments, a compressible element (e.g., the compressible element 160 in FIGS. 1 and 2) and/or a spacing element may separate the superabrasive cutting element 810 from the base 830. The compressible element and/or spacing element may be shaped to have a similar footprint as the superabrasive cutting element 810 and/or base 830.

Figure 12:
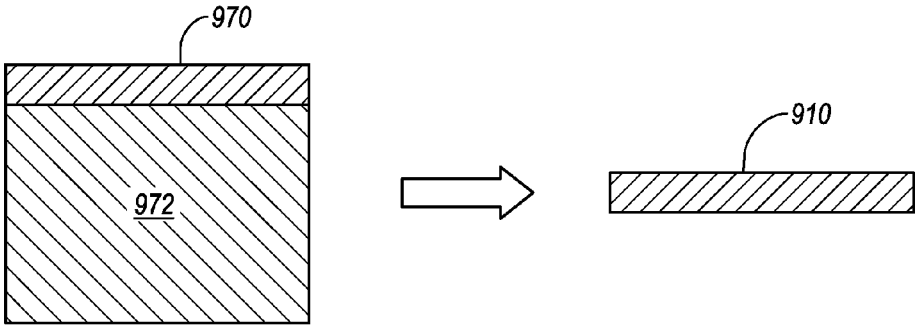
FIG. 12 is a cross-sectional view of an embodiment of a method of manufacturing a superabrasive cutting element.

FIG. 12 is a cross-sectional view of an embodiment of a method of manufacturing a superabrasive cutting element 910. The method may be used to manufacture the superabrasive cutting elements described herein, such as superabrasive cutting elements 110, 410, 510, 610, 710, 810 shown in FIGS. 1 and 2 and 5-11, spacing elements, other elements, or combinations thereof.

The method may include subjecting a superabrasive material 970 disposed on a substrate 972 to an HPHT process that sinters the superabrasive material 970 to form a superabrasive cutting element 910 integrally formed and bonded to the substrate 970. For example, the superabrasive material 970 may comprise diamond powder placed on the substrate 972 that may comprise cobalt-cemented tungsten carbide. During the HPHT process, cobalt from the substrate may sweep into the diamond powder to catalyze formation of a PCD table.

The substrate 972 may then be removed by grinding or other methods to separate the superabrasive cutting element 910 so formed from the underlying substrate 972. In some embodiments, the superabrasive cutting element 910 may be at least partially leached to remove catalyst material therefrom, such as removing cobalt from sintered PCD, after separation from the substrate 972.

After the superabrasive cutting element 910 is separated, the superabrasive cutting element 910 may be shaped (if desired or needed) and assembled into a cutting element assembly described herein, such as cutting element assemblies 102, 402, 502, 602, 702, 802 shown in FIGS. 1 and 2 and 5-11. For example, the superabrasive cutting element 910 may be shaped by grinding, electro-discharge machining, or combinations thereof.

In other embodiments, the superabrasive cutting element 910 may be fabricated by infiltrating, for example, diamond powder with a catalyst material (e.g., cobalt, iron, nickel, or alloys thereof) from a catalyst material disk in an HPHT process. In a further embodiment, catalyst material particles (e.g., particles made from cobalt, iron, nickel, or alloys thereof) may be mixed with diamond powder and subjected to an HPHT process.

When the superabrasive cutting element 910 is at least partially leached, it may be re-infiltrated with a replacement material that may help limit crack growth in the at least partially leached superabrasive cutting element 910 during cutting. For example, the replacement material may include one or more metal carbonates (e.g., one or more alkali metal carbonates), silicon, a silicon-cobalt alloy, combinations of the foregoing, or another suitable material. Silicon and a silicon-cobalt alloy may react with diamond grains to form silicon carbide and/or other reaction product.

Figure 13:
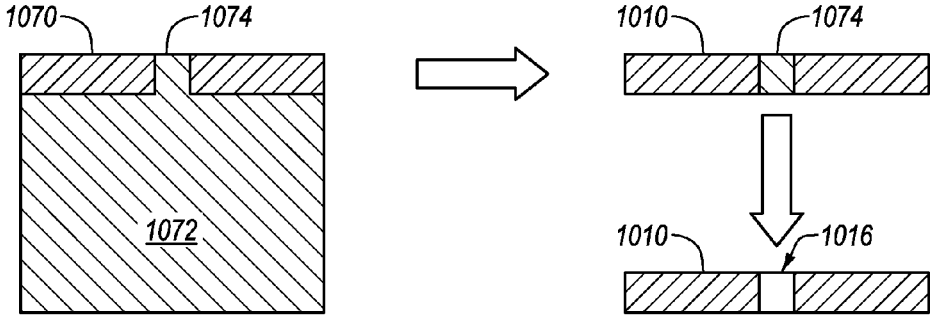
FIG. 13 is cross-sectional view of an embodiment of a method of manufacturing a superabrasive cutting element with a through hole.

In some embodiments, a superabrasive cutting element may be mechanically fastened to a substrate instead of using the disclosed enclosures. FIG. 13 is a cross-sectional view of another embodiment of a method of manufacturing a superabrasive cutting element 1010 with a through hole 1016 extending therethrough in a thickness direction to allow the superabrasive cutting element 1010 to be fastened to a substrate. The method may include sintering a superabrasive material 1070 (e.g., diamond powder) on a substrate 1072 (e.g., a cobalt-cemented tungsten carbide substrate) in an HPHT process to form a superabrasive cutting element 1010. The substrate 1072 may include a protrusion 1074. The superabrasive material 1070 may be formed to conform to and extend about the protrusion 1074. The substrate 1072 may then be removed by grinding or other methods to separate the superabrasive cutting element 1010 from the bulk of the substrate 1072.

The protrusion 1074 may be removed from the superabrasive cutting element 1010 to form a through hole 1016. In some embodiments, the protrusion 1074 may be mechanically removed from the superabrasive cutting element 1010, such as by mechanical machining (e.g., drilling), laser ablation, abrasive blasting, electro-discharge machining, or combinations of the foregoing processes. In other embodiments, the protrusion 1074 may be chemically removed from the superabrasive cutting element 1010. For example, the superabrasive cutting element 1010 including the protrusion 1074 may be immersed in an acid to substantially simultaneously leach a catalyst material from the superabrasive cutting element 1010 and a cementing constituent in the protrusion 1074 (e.g., cobalt in a cobalt-cemented tungsten carbide substrate). In further embodiments, superabrasive cutting element 1010 may be at least partially or fully leached after mechanically removing the protrusion 1074.

Figure 14:
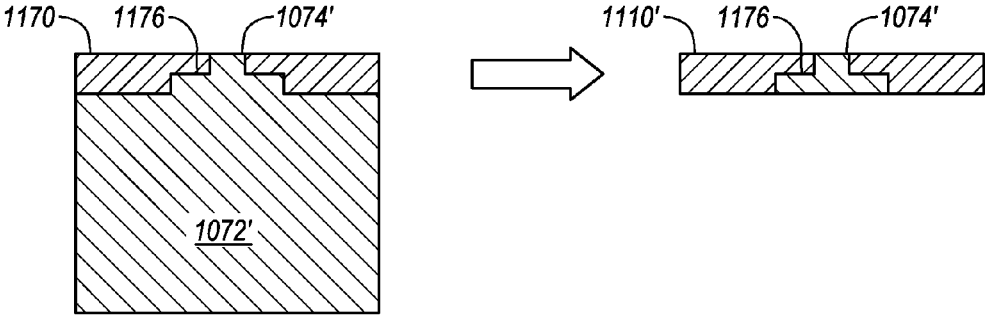
FIGS. 14 and 15 are cross-sectional views of an embodiment of a method of manufacturing a cutting element with a counterbored through hole.
Figure 15:
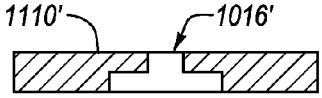

In some embodiments, the through hole may be formed to exhibit a counterbored geometry. As shown in FIG. 14, the method may include sintering a superabrasive material 1170 on a substrate 1072' to form a superabrasive cutting element 1110'. The substrate 1072' may include a protrusion 1074'. As with the method shown in FIG. 13, the superabrasive material 1170 may be sintered about the protrusion 1074'. The substrate 1072' and the protrusion 1074' may then be removed using the same or similar methods described in FIG. 13 to remove the protrusion 1074 and form a through hole 1016' having a countered geometry as shown in FIG. 15.

In embodiments where the protrusion 1074/1074' is excluded, a through hole may be formed after, for example, the superabrasive cutting element 910 is formed. For example, the through hole may be formed using a mechanical process, laser ablation, a chemical process, another material removal processes, or combinations thereof.

Figure 16:
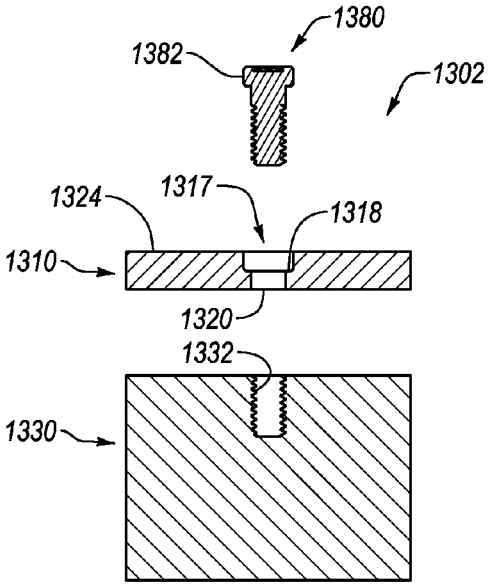
FIG. 16 is an exploded side cross-sectional view of an embodiment of a cutting element assembly including a superabrasive cutting element that is fastened to a base with a fastener.
Figure 17:
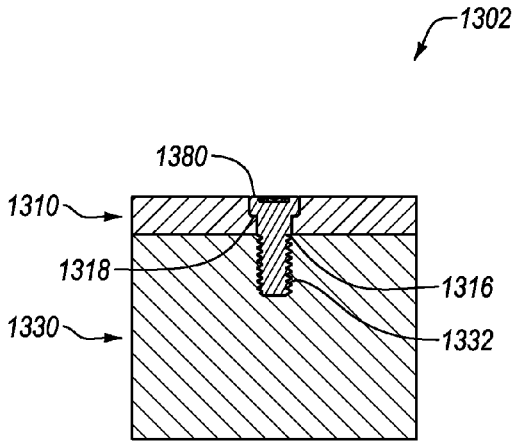
FIG. 17 is an assembled side cross-sectional view of the cutting element assembly shown in FIG. 16.

Referring to FIGS. 16 and 17, any of the superabrasive cutting elements disclosed herein having a through hole formed therein may be used to form a superabrasive compact, FIG. 16 is an exploded side cross-sectional view of an embodiment of a cutting element assembly 1302 and FIG. 17 is an assembled side cross-sectional view of the cutting element assembly 1302 shown in FIG. 16. The cutting element assembly 1302 may include a superabrasive cutting element 1310 that may be retained against a base 1330 via a fastener 1380. For example, the base 1330 may comprise a cemented carbide material, such as cobalt-cemented tungsten carbide or other suitable carbide. The superabrasive cutting element 1310 includes a through hole 1317 extending therethrough in a thickness direction, which includes an enlarged counterbored portion 1318 and a reduced diameter portion 1320. The fastener 1380 may be a screw, a press-fit post, a snap-fit post, a rivet, or other fastener. The fastener 1380 may be formed from, for example, a cobalt-chromium alloy.

In the illustrated embodiment, the superabrasive cutting element 1310 may be retained against the base 1330 by a fastener 1380, but without brazing. In other embodiments, superabrasive cutting element 1310 may be retained against the base 1330 by a fastener 1380 and brazing. In embodiments, where the superabrasive cutting element 1310 is retained against the base 1330 without brazing, instant repair and/or replacement may be feasible and/or thermal damage which may occur in conventional brazing of superabrasive cutting elements such as PCD cutting elements may be prevented.

Retaining the superabrasive cutting element 1310 against the base 1330 may improve the damage tolerance of the superabrasive cutting element 1310. For example, the combination of the fastener 1380 and the base 1330 may induce axial compressive stresses in the superabrasive cutting element 1310 that may improve the ability of the superabrasive cutting element 1310 to withstand environmental conditions and/or forces applied to the superabrasive cutting element 1310. Retaining the superabrasive cutting element 1310 against the base 1330 may limit and/or prevent any axial and/or rotational movement of the superabrasive cutting element 1310.

The fastener 1380 may be inserted through the through hole 1317 of the superabrasive cutting element 1310 and engage an engaging surface 1332 of the base 1330. In the illustrated embodiment, the engaging surface 1332 and the fastener 1380 may be threaded. In other embodiments, the cutting element assembly 1302 may include other engaging features, such as press-fit surfaces, snap-fitting surfaces, at least one connection protrusion, slidably engaging surfaces, other engaging features, or combinations thereof.

The fastener 1380 may include a recess-engaging feature 1382 (e.g., a bolt head) that resides in the enlarged counterbored portion 1318 of the through hole 1317 so that a top of the bolt head is recessed therein or flush with an upper surface 1324 of the superabrasive cutting element. In the illustrated embodiment, the recess-engaging feature 1382 is a bolt head. In other embodiments, the recess-engaging feature 1382 may be a tapered screw head, a flat screw head, other fastener head, or combinations thereof. The recess-engaging feature 1382, in embodiments with or without the enlarged counter-bore portion 1318, may engage the upper surface 1324 of the superabrasive cutting element 1310.

The fastener 1380 may further include a driving slot or other driving recess (e.g., a hexagonal recess) or protrusion that may facilitate applying stresses to the superabrasive cutting element 1310. For example, in embodiments where the engaging surface 1332 of the base 1330 and/or the fastener 1380 are threaded, the driving slot may be used to further direct the superabrasive cutting element 1310 and the base 1330 together using, for example, a screwdriver. In further embodiments, the torque applied between the superabrasive cutting element 1310 and the base 1330 may be specified and/or monitored when assembling the cutting element assembly 1302.

When assembled, the cutting element assembly 1302 may be connected to a drill bit body of a rotary drill bit by brazing the base 1330 to the drill bit body and/or other means. In other embodiments, the base 1330 may define part of a cutter pocket of a drill bit body to which the superabrasive cutting element 1310 is directly connected. In either embodiment, the superabrasive cutting element 1310 may be removed after use and/or replaced with a new superabrasive cutting element, as need or desired.

Figure 18:
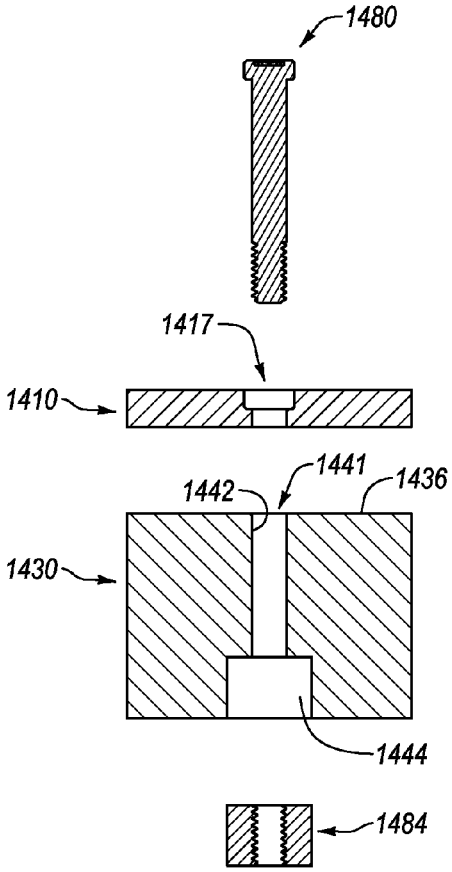
FIG. 18 is an exploded side cross-sectional view of another embodiment of a cutting element assembly configured to limit axial rotation of a superabrasive cutting element.

FIG. 18 is an exploded side cross-sectional view of another embodiment of a cutting element assembly 1402. The cutting element assembly 1402 of this other embodiment may be functionally similar to the cutting element assembly 1302 and the superabrasive cutting elements 1310 previously described above and shown in FIGS. 16 and 17 in most respects, wherein certain features will not be described in relation to this embodiment wherein those components may function in the manner as described above and are hereby incorporated into this alternative embodiment described below. In addition, certain features described in connection with the embodiment described below may be incorporated into other embodiments described herein.

The cutting element assembly 1402 may include a superabrasive cutting element 1410 that may be retained against a base 1430 by a fastener 1480. In the illustrated embodiment, the superabrasive cutting element 1410 may be retained against the base 1430 by the fastener 1480, but without brazing. In other embodiments, superabrasive cutting element 1410 may be retained against the base 1430 by the fastener 1480 and brazing. Retaining the superabrasive cutting element 1410 against the base 1430 may improve the damage tolerance of the superabrasive cutting element 1410 by imparting axial compressive stresses to the superabrasive cutting element 1410.

The fastener 1480 may be inserted through a through hole 1417 formed in the superabrasive cutting element 1410 and through an axially-extending counterbored through hole 1441 formed in the base 1430, which includes an enlarged counterbored portion 1444 and a smaller portion 1442. The retaining recess 1444 may be sized to receive a nut 1484 or other mechanism configured to retain the fastener 1480.

The fastener 1480 is inserted through the superabrasive cutting element 1410 and the through hole 1441 formed in the base 1430 to engage the nut 1484. In the illustrated embodiment, the nut 1484 and/or the fastener 1480 may be threaded. In other embodiments, the cutting element assembly 1402 may include other engaging features, such as press-fit surfaces, snap fitting surfaces, at least one connection protrusion, slidably engaging surfaces, other engaging features, or combinations thereof.

Figure 19:
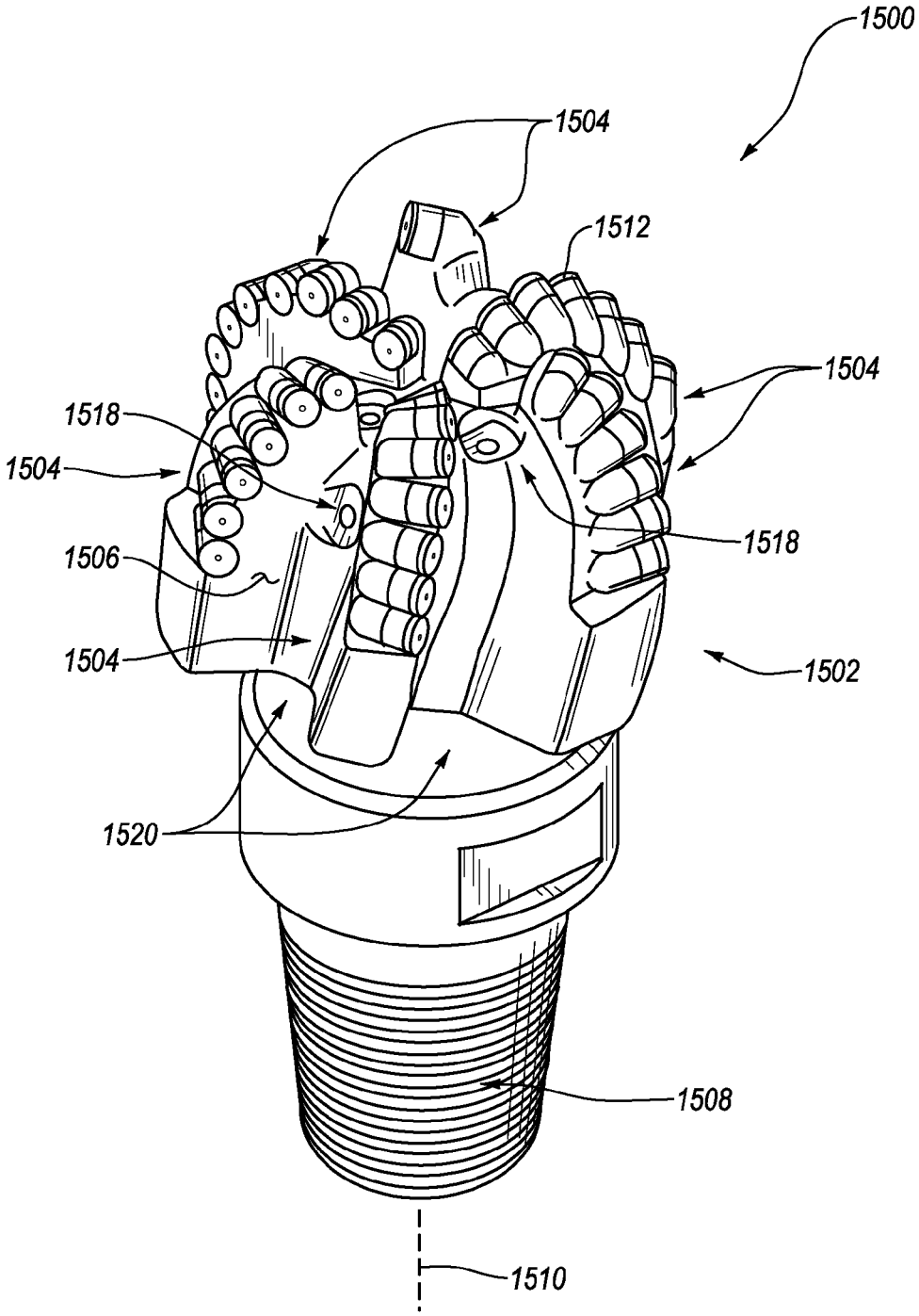
FIG. 19 is an isometric view of an embodiment of a rotary drill bit that may employ one or more of the disclosed cutting element assembly embodiments.
Figure 20:
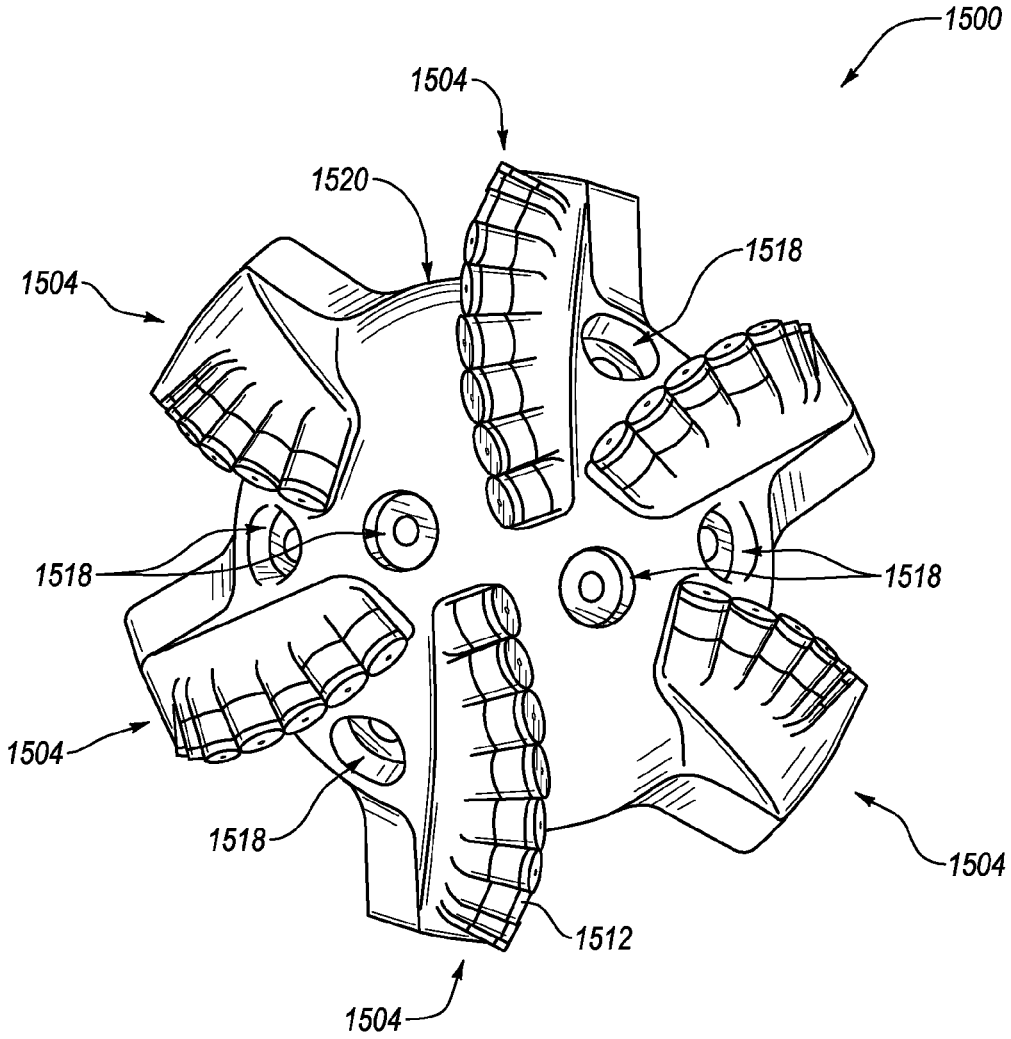
FIG. 20 is a top elevation view of the rotary drill bit shown in FIG. 19.

FIG. 19 is an isometric view and FIG. 20 is a top elevation view of an embodiment of a rotary drill bit 1500 that may employ one or more of the disclosed cutting element assembly embodiments. The rotary drill bit 1500 comprises a bit body 1502 that includes radially- and longitudinally-extending blades 1504 having leading faces 1506, and a threaded pin connection 1508 for connecting the bit body 1502 to a drilling string. The bit body 1502 defines a leading end structure for drilling into a subterranean formation by rotation about a longitudinal axis 1510 and application of weight-on-bit. At least one cutting element assembly, configured according to any of the previously described cutting element assembly embodiments, may be affixed to the bit body 1502. Each of a plurality of cutting element assemblies 1512 is secured to the blades 1504 of the bit body 1502. For example, each cutting element assembly 1512 is illustrated as the cutting element assembly 1302 shown in FIGS. 16 and 17. However, each cutting element assembly 1512 may comprise any cutting element assembly disclosed herein, without limitation. In addition, if desired, in some embodiments, a number of the cutting element assemblies 1512 may be conventional in construction. Also, circumferentially adjacent blades 1504 define so-called junk slots 1520 therebetween. Additionally, the rotary drill bit 1500 includes a plurality of nozzle cavities 1518 for communicating drilling fluid from the interior of the rotary drill bit 1500 to the cutting element assemblies 1512.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall have the same meaning as the word "comprising" and variants thereof (e.g., "comprise" and "comprises").

What is claimed is:

1. A cutting element assembly, comprising:

an enclosure defining a recess, at least one cutting opening, and a longitudinal axis;

a base disposed in the recess; and a superabrasive cutting element disposed in the recess between the enclosure and the base, the superabrasive cutting element exposed through the at least one cutting opening, the rotation of the superabrasive cutting element relative to the enclosure about the longitudinal axis of the enclosure being restricted.

2. The cutting element assembly of claim 1 wherein the superabrasive cutting element comprises polycrystalline diamond.

3. The cutting element assembly of claim 1 wherein the enclosure is connected to the base by at least one of threads, a press fit, a snap fit, welding, brazing, or gluing.

4. The cutting element assembly of claim 1 wherein the enclosure comprises at least one connecting member, wherein the base comprises at least one connecting channel, the at least one connecting member being received by the at least one connecting channel.

5. The cutting element assembly of claim 1 wherein at least one cutting opening comprises a plurality of cutting openings exposing a portion of the superabrasive cutting element therethrough.

6. The cutting element assembly of claim 1 wherein the superabrasive cutting element is sufficiently compressed between the base and the enclosure so that a damage tolerance thereof is increased.

7. The cutting element assembly of claim 1, further comprising a compressible element disposed in the recess that is configured to selectively distribute force applied to the superabrasive cutting element.

8. The cutting element assembly of claim 1, further comprising a backing element, the base being positioned between the backing element and the superabrasive cutting element, the backing element bonded to at least the enclosure and/or the base.

9. The cutting element assembly of claim 1, further comprising one or more spacing elements disposed between the base and the superabrasive cutting element.

10. The cutting element assembly of claim 1 wherein the superabrasive cutting element and the base are bonded together.

11. The cutting element assembly of claim 1 wherein the superabrasive cutting element is bonded to the enclosure.

12. The cutting element assembly of claim 1 wherein the superabrasive cutting element is at least partially leached of catalyst.

13. A cutting element assembly, comprising:

a base including a base through hole having a threaded nut disposed therein;

a superabrasive cutting element positioned adjacent to the base and having at least one through hole extending thicknesswise therethrough; and a fastener inserted through the at least one through hole of the superabrasive cutting element and coupled to the threaded nut to mechanically connect the base to the superabrasive cutting element.

14. The cutting element assembly of claim 13 wherein the through hole comprises a counterbored through hole.

15. The cutting element assembly of claim 13 wherein the fastener includes a head that resides in an enlarged counterbored portion of the through hole.

16. The cutting element assembly of claim 13 wherein the fastener comprises a screw, a press-fit post, a snap-fit post, or a rivet.

17. The cutting element assembly of claim 13 wherein the superabrasive cutting element is at least partially leached of catalyst.

18. A rotary drill bit, comprising:

a bit body configured to engage a subterranean formation; and a plurality of superabrasive cutting elements mounted to the bit body, at least one of the plurality of superabrasive cutting elements including, an enclosure defining a recess, at least one cutting opening, and a longitudinal axis;

a base disposed in the recess; and a superabrasive cutting element disposed in the recess between the enclosure and the base, the superabrasive cutting element exposed through the at least one cutting opening in the enclosure, the rotation of the superabrasive cutting element relative to the enclosure being restricted about the longitudinal axis of the enclosure.

19. A cutting element assembly, comprising:

an enclosure defining a recess and at least one cutting opening;

a base disposed in the recess; and a superabrasive cutting element disposed in the recess between the enclosure and the base, the superabrasive cutting element exposed through the at least one cutting opening in the enclosure, the superabrasive cutting element being axially compressed between the base and the enclosure.

20. A rotary drill bit, comprising:

a bit body configured to engage a subterranean formation; and a plurality of superabrasive cutting elements mounted to the bit body, at least one of the plurality of superabrasive cutting elements including, an enclosure defining a recess and at least one cutting opening;

a base disposed in the recess; and a superabrasive cutting element disposed in the recess between the enclosure and the base, the superabrasive cutting element exposed through the at least one cutting opening in the enclosure, the superabrasive cutting element being axially compressed between the base and the enclosure.

21. A cutting element assembly, comprising:

an enclosure defining a recess, at least one cutting opening, and a longitudinal axis;

a base disposed in the recess; and one or more superabrasive cutting elements disposed in the recess between the enclosure and the base, the one or more superabrasive cutting elements exposed through the at least one cutting opening, the one superabrasive cutting elements rotatable about the longitudinal axis.

22. The cutting element assembly of claim 21 wherein the one or more superabrasive cutting elements comprise one or more polished polycrystalline diamond disks and the base comprises a polycrystalline diamond compact.

* * * * *